US009677744B1

(12) United States Patent
Clements

(10) Patent No.: US 9,677,744 B1
(45) Date of Patent: Jun. 13, 2017

(54) COMPONENT HOUSING BAND IN LUMINAIRES

(71) Applicant: Cooper Technologies Company, Houston, TX (US)

(72) Inventor: Steven Russell Clements, Atlanta, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 15/362,174

(22) Filed: Nov. 28, 2016

(51) Int. Cl.

| | |
|---|---|
| ***F21V 3/00*** | (2015.01) |
| ***F21V 17/06*** | (2006.01) |
| ***F21V 5/04*** | (2006.01) |
| ***F21V 23/04*** | (2006.01) |
| ***F21V 7/00*** | (2006.01) |
| ***F21V 23/00*** | (2015.01) |
| ***F21S 8/02*** | (2006.01) |
| ***F21V 15/015*** | (2006.01) |
| ***F21S 9/02*** | (2006.01) |
| *F21Y 115/10* | (2016.01) |

(52) U.S. Cl.
CPC ..... *F21V 17/06* (2013.01); *F21S 8/02* (2013.01); *F21S 9/022* (2013.01); *F21V 5/04* (2013.01); *F21V 7/00* (2013.01); *F21V 15/015* (2013.01); *F21V 23/002* (2013.01); *F21V 23/04* (2013.01); *F21V 23/0471* (2013.01); *F21Y 2115/10* (2016.08)

(58) Field of Classification Search
CPC . F21V 17/06; F21V 3/00; F21V 5/048; F21V 23/04; F21S 8/02; F21Y 2101/02
See application file for complete search history.

(56) References Cited

U.S. PATENT DOCUMENTS

| | | | | |
|---|---|---|---|---|
| 6,733,154 | B1 * | 5/2004 | Dahlen | F21V 7/0016 362/217.06 |
| 7,559,672 | B1 * | 7/2009 | Parkyn | A47B 97/00 362/127 |
| 7,862,199 | B2 * | 1/2011 | Ladstatter | F21S 8/02 362/147 |
| 8,950,905 | B2 | 2/2015 | Howe | |
| 9,291,330 | B2 * | 3/2016 | Yang | F21V 3/02 |
| 9,506,630 | B1 * | 11/2016 | Clements | F21V 5/048 |
| 2007/0211457 | A1 * | 9/2007 | Mayfield, III | F21S 8/02 362/223 |

* cited by examiner

*Primary Examiner* — Ali Alavi
(74) *Attorney, Agent, or Firm* — King & Spalding LLP

(57) ABSTRACT

A component housing band includes a center portion that comprises an aperture extending through the center portion and a mounting structure disposed adjacent to the aperture. The mounting structure extends from a surface of the center portion in a direction that is substantially normal to the corresponding surface of the center portion. The mounting structure engages the ends of a notch in a lens and forms a cavity to house an electronic component. Further, the component housing band includes a first elongated arm portion and a second elongated arm portion integral with the center portion and extending away from opposite ends of the center portion in opposite directions, respectively. The ends of the first elongated arm portion and the second elongated arm portion that are away from the center portion and opposite to each other are adapted to engage with corresponding latch structures of the lens.

19 Claims, 9 Drawing Sheets

COMPONENT HOUSING BAND IN LUMINAIRES

CROSS REFERENCE TO RELATED APPLICATIONS

This application is a continuation application of and claims priority under 35 U.S.C. §120 to U.S. patent application Ser. No. 14/699,765, titled "Component Housing Band in Luminaires," filed on Apr. 29, 2015. The entire content of the foregoing application is hereby incorporated herein by reference.

TECHNICAL FIELD

Embodiments of the present disclosure relate generally to luminaires, and more particularly to a component housing band in luminaires.

BACKGROUND

Modern luminaires are typically equipped with various electronic components for efficient operation and commissioning (e.g., activation, functional testing, etc.) of the luminaires. Some of these electronic components, such as motion sensors and emergency battery test switches need to be positioned within the luminaire such that they have a line of sight to detect motion/occupancy in a room and/or are easily accessible/viewable during commissioning operations such as functional testing (e.g., emergency unit testing) of the luminaire. A lens of the luminaire provides a desirable location to position the electronic components since the lens faces the area that is to be illuminated, e.g., room and hence has a line of sight to detect motion in the room and is easily accessible or viewable to a user in the room. However, conventional lenses do not lend to the capability of mounting electronic components on the lens in a position that allows for a line of sight and/or easy accessibility. Further, electrical wires attached to the electronic components may affect an aesthetic appeal of the luminaire in an undesirable manner. Therefore, there is a need for a technology that facilitates mounting of electronic components on a luminaire such that the electronic components have a line of sight with the external environment and/or are easily accessible/viewable without compromising the aesthetic appeal of the luminaire.

SUMMARY

In general, in one aspect, the disclosure relates to a luminaire that includes at least one light source, a lens disposed over the at least one light source; and an elongated member removably coupled to the lens and configured to house an electronic component. The elongated member includes a center portion. The center portion includes a top surface and a bottom surface facing a direction that is opposite to that of the top surface. Further, the center portion includes an aperture extending from the top surface through the bottom surface. Furthermore, the center portion includes a mounting structure disposed adjacent to the aperture and extending from one of the top surface and the bottom surface in a direction that is substantially normal to the corresponding surface of the center portion. In addition to the center portion, the elongated member includes a first elongated arm portion integral with the center portion and extending away from a first end of the center portion in a first direction, and a second elongated arm portion integral with the center portion and extending away from a second end of the center portion in a second direction that is opposite to the first direction. The second end and the second end of the center portion are opposite to each other. Further, the ends of the first elongated arm portion and the second elongated arm portion that are away from the center portion and opposite to each other are adapted to engage with corresponding latch structures of the lens to removably couple the elongated member to the lens.

In another aspect, the disclosure can generally relate to a band apparatus that houses an electronic component in a luminaire. The band apparatus includes a top surface and a bottom surface facing a direction that is opposite to that of the top surface. Further, the band apparatus includes an aperture extending from the top surface through the bottom surface. Furthermore, the band apparatus includes a mounting structure disposed adjacent to the aperture and extending from one of the top surface and the bottom surface in a direction that is substantially normal to the corresponding surface of the center portion. The mounting structure surrounds at least a portion of a perimeter of the aperture and forms a cavity to house the electronic component. The cavity is located above the aperture such that at least a portion of the electronic component rests in the cavity above the aperture. Further, the mounting structure is adapted to securely engage a notch in a component of the luminaire when the elongated member is coupled to the component.

In yet another aspect, the disclosure can generally relate to a lighting system that includes at least one light source, a lens disposed over the at least one light source, and an elongated member housing a component. The elongated member includes a first surface and a second surface facing a direction that is opposite to the first surface. The first surface and the second surface are bound by a first lateral edge and a second lateral edge opposite to the first lateral edge. Each of the first lateral edge and the second lateral edge is adapted to engage with a corresponding latch structure of the lens. The first surface and the second surface are also bound by a first longitudinal edge and a second longitudinal edge opposite to the first longitudinal edge. Each of the first longitudinal edge and the second longitudinal edge extends between the first lateral edge and the second lateral edge of the elongated member. Further, the elongated member includes an aperture disposed between the first longitudinal edge and the second longitudinal edge. The aperture extends from the first surface through the second surface. Furthermore, the elongated member includes a mounting structure disposed adjacent the aperture and extending substantially perpendicularly from one of the first surface and the second surface. The mounting structure surrounds at least a portion of a perimeter of the aperture and forms a cavity above the aperture to house the component.

These and other aspects, objects, features, and embodiments will be apparent from the following description and the appended claims.

BRIEF DESCRIPTION OF THE DRAWINGS

For a more complete understanding of the disclosure and the advantages thereof, reference is now made to the following description, in conjunction with the accompanying figures briefly described as follows.

Figure 1B:
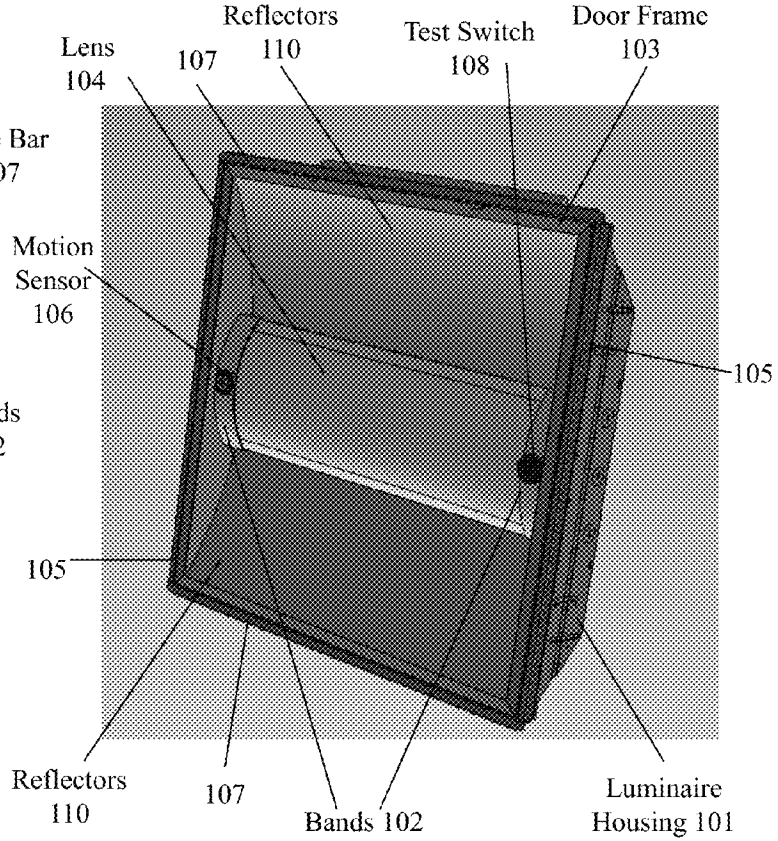
FIGS. 1A and 1B (collectively 'FIG. 1') illustrate different views of a luminaire with component housing bands disposed on a lens of the luminaire, in accordance with example embodiments of the present disclosure.

The drawings illustrate only example embodiments of the disclosure and are therefore not to be considered limiting of its scope, as the disclosure may admit to other equally effective embodiments. The elements and features shown in the drawings are not necessarily to scale, emphasis instead being placed upon clearly illustrating the principles of example embodiments of the present disclosure. Additionally, certain dimensions may be exaggerated to help visually convey such principles.

DETAILED DESCRIPTION OF EXAMPLE EMBODIMENTS

In the following paragraphs, the present disclosure will be described in further detail by way of examples with reference to the attached drawings. In the description, well known components, methods, and/or processing techniques are omitted or briefly described so as not to obscure the disclosure. As used herein, the "present disclosure" refers to any one of the embodiments of the disclosure described herein and any equivalents. Furthermore, reference to various feature(s) of the "present disclosure" is not to suggest that all embodiments must include the referenced feature(s).

The present disclosure provides an example component housing band (herein 'band') for mounting example electronic components such as motion sensors and/or emergency battery test switches on a lens of a luminaire. In particular, the band houses the electronic component and the band is removably coupled to the lens of the luminaire, thereby indirectly mounting the electronic component on the lens of the luminaire. In certain example embodiments, the band may be coupled to the lens at a position that provides easy accessibility to the electronic component and/or a line of sight for the electronic component. In addition to mounting the electronic component to the lens of the luminaire, the band also conceals electrical wires associated with the electronic components and/or other components of the luminaire to preserve and/or enhance an aesthetic appeal of the luminaire.

Although the present disclosure illustrates and describes the motion sensor and/or the emergency battery test switch, one of ordinary skill in the art can understand and appreciate that the motion sensor and emergency battery test switch are examples and do not limit the size, shape, or kind of electronic components that the band can accommodate. In other words, the band can house any other appropriate electronic/electrical component without departing from a broader scope of the present disclosure. Further, even though the present disclosure describes the band housing an electronic/electrical component, one of ordinary skill in the art can understand and appreciate that the band can be adapted to house any other appropriate component of the luminaire, e.g., mechanical component, optics component, etc., without departing from a broader scope of the present disclosure. Furthermore, the electronic components may be coupled to the luminaire using the band in a different configuration than that illustrated in the example figures of the present disclosure. That is, the present technology can be embodied in many different forms and should not be construed as limited to the embodiments set forth herein; rather, these embodiments are provided so that this disclosure will be thorough and complete, and will fully convey the scope of the technology to those having ordinary skill in the art. Furthermore, all "examples" or "exemplary embodiments" given herein are intended to be non-limiting and among others supported by representations of the present technology.

Figure 1A:
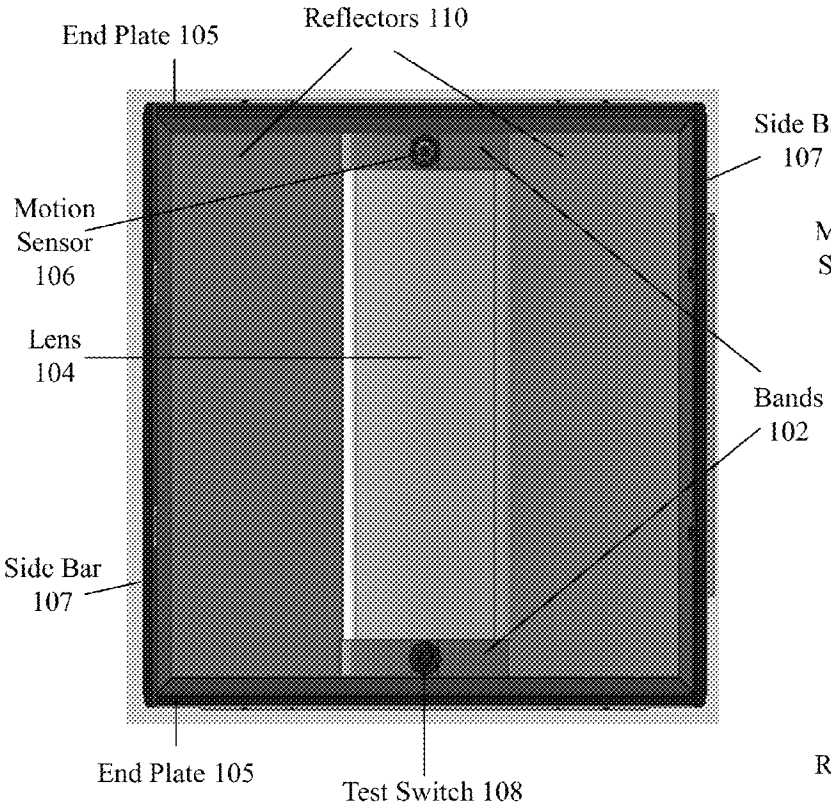

Turning to FIG. 1, this figure illustrates different views of an example recessed troffer luminaire having component housing bands disposed on a lens of the recessed troffer luminaire, in accordance with example embodiments of the present disclosure. In particular, FIG. 1A illustrates a bottom view of the recessed troffer luminaire and FIG. 1B illustrates a perspective view of the recessed troffer luminaire. Other views of the recessed troffer luminaire are omitted so as not to obscure the disclosure. Although the present disclosure describes an example recessed troffer luminaire, one of ordinary skill in the art can understand and appreciate that any other appropriate luminaire can be substituted without departing from a broader scope of this disclosure.

Referring to FIGS. 1A and 1B, the example recessed troffer luminaire 100 includes a housing 101 that is coupled to a door frame 103. The door frame 103 includes two endplates 105 and two side bars 107 extending between and coupled to the two endplates 105 at opposing ends to form a rectangular outer frame. In certain example embodiments, the housing 101 in unison with the door frame 103 securely retains, inter alia, one or more light sources (not shown in the Figures), a lens 104 disposed over the one or more light sources, and one or more reflectors 110 adjacent the lens 104. In one example embodiment, the one or more light sources described herein may include light emitting diodes (LEDs), whereas in other example embodiments, any other appropriate light sources may be substituted.

In addition to the light sources, the lens 104, and the reflectors 110, the example recessed troffer luminaire 100 may include one or more bands 102 that house electronic components such as the motion sensor 106 and/or the emergency battery test switch 108. The band(s) 102 may be coupled to and disposed on the lens 104 of the luminaire, as illustrated in FIGS. 1A and 1B. In particular, the band(s) 102 may be coupled to lateral ends of the lens 104 adjacent to the end plate 105 of the door frame 103 and the band(s) 102 may extend along the lateral length of the lens 104 (length between the longitudinal ends of the lens), as illustrated in FIGS. 1A and 1B. However, in some example embodiments, the band(s) 102 may be coupled to the lens 104 at any other position on the lens 104 such that the band(s) 102 are visible externally and/or an electronic component housed in the band(s) 102 is accessible/viewable and/or have a line of sight to detect motion in an area illuminated by the luminaire 100. Although the present disclosure describes the band as being coupled to the lens of the luminaire, one of ordinary skill in the art can understand and appreciate that in some embodiments, the band may be coupled to any other component of the luminaire without departing from a broader scope of the present disclosure. The band 102 will be described in greater detail below in association with FIGS. 2-7.

Figure 2:
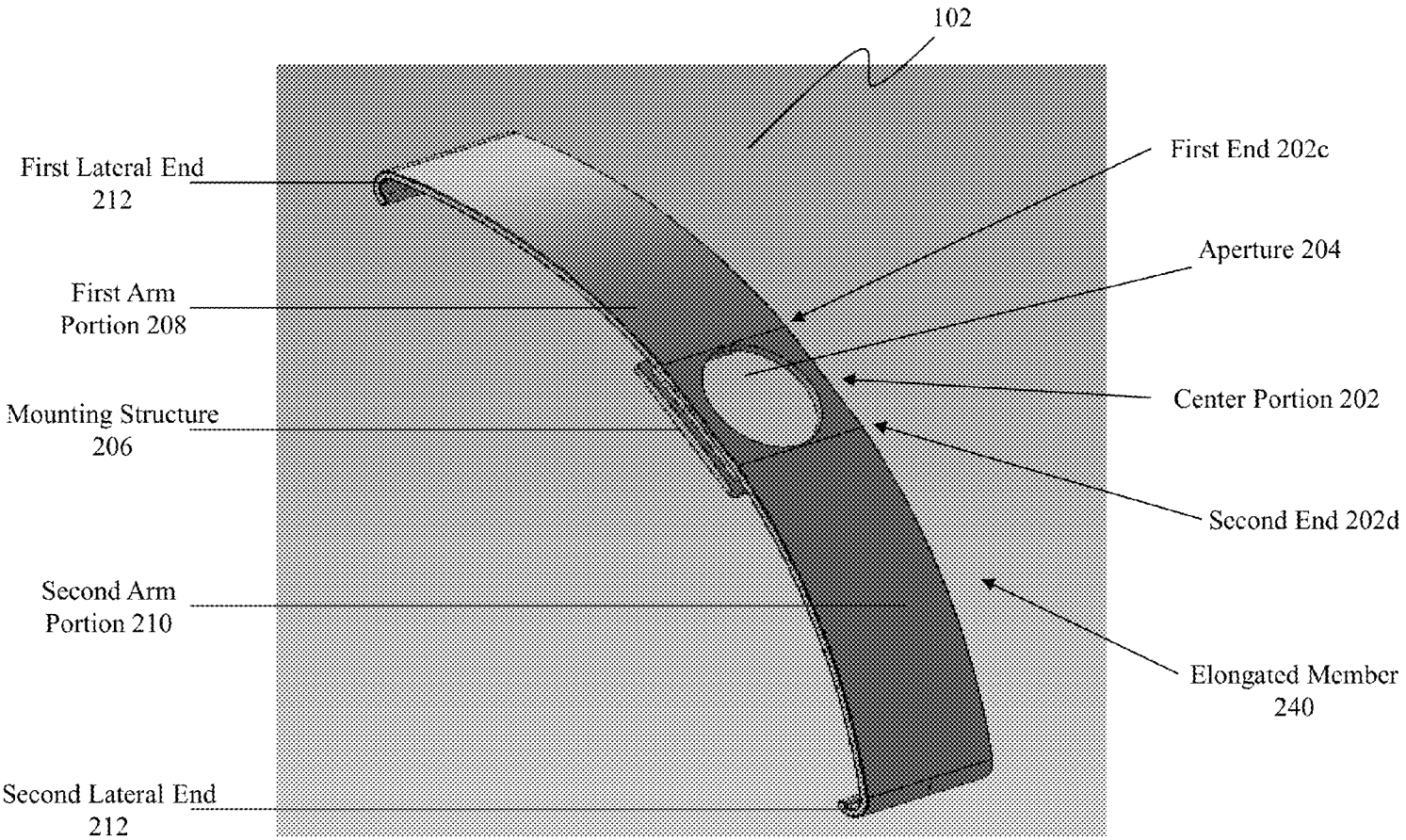
FIG. 2 illustrates a perspective view of the component housing band, in accordance with example embodiments of the present disclosure.
Figure 3:
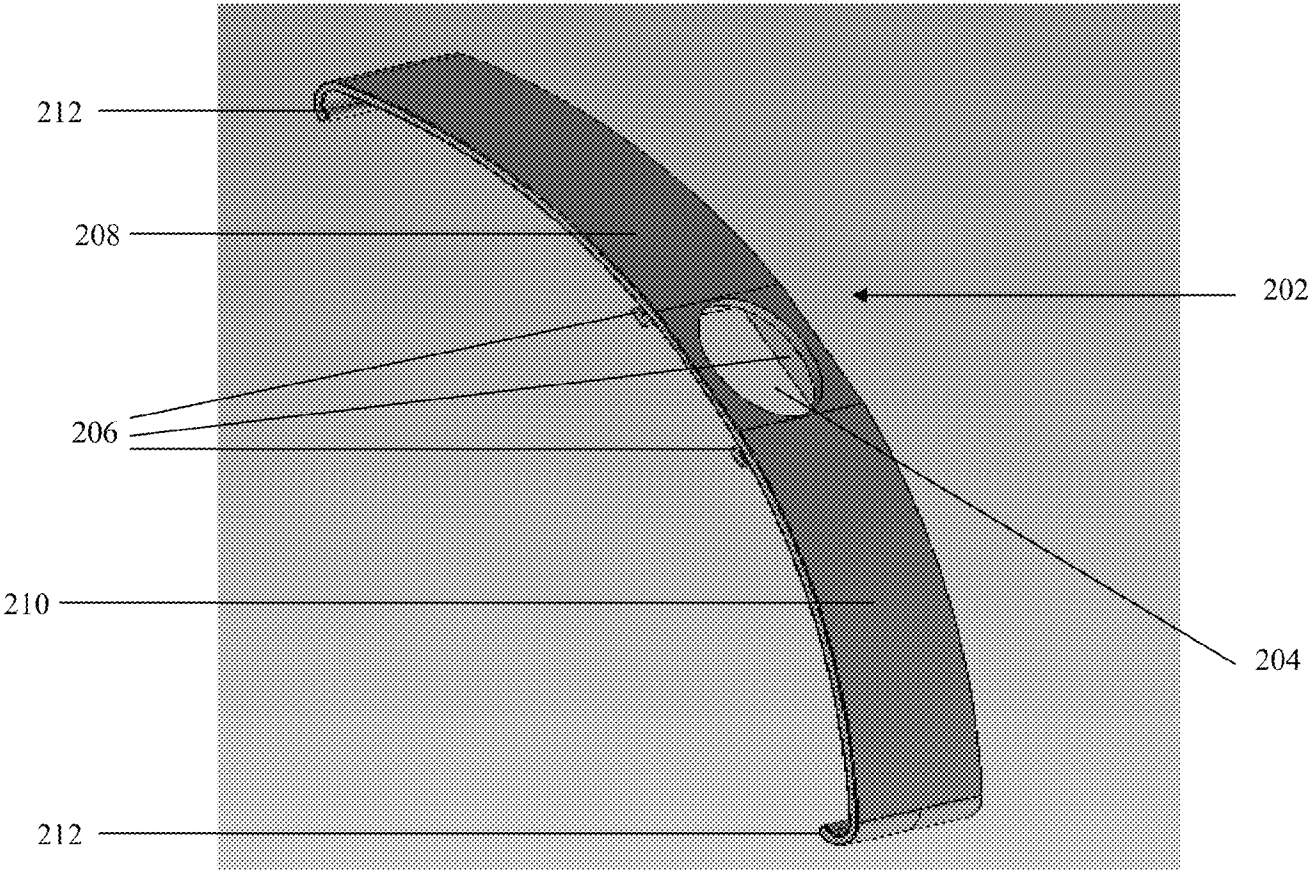
FIG. 3 illustrates another perspective view of the component housing band from the opposite side as that shown in FIG. 2, in accordance with example embodiments of the present disclosure.
Figure 5:
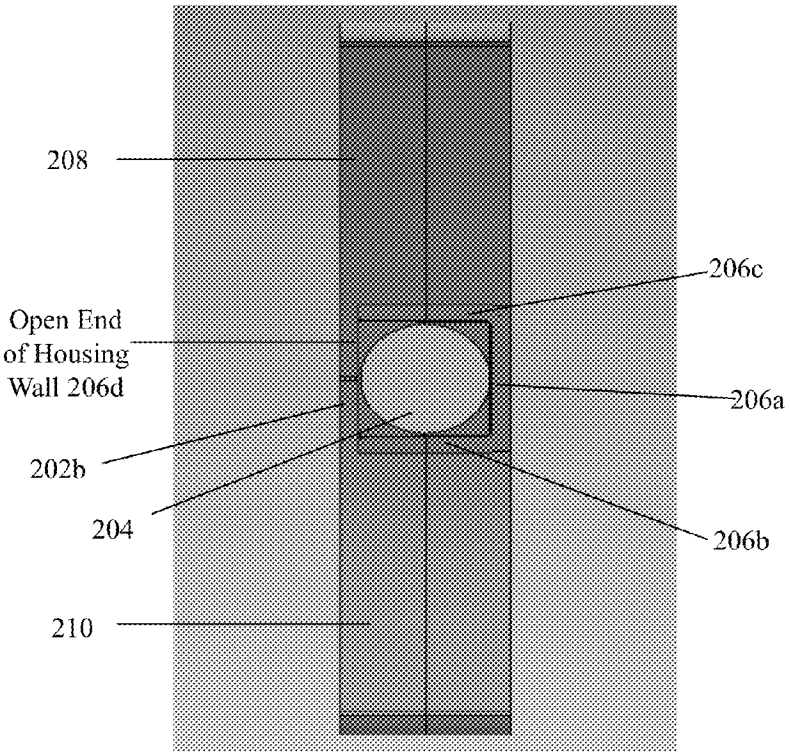
FIG. 5 illustrates a rear view of the component housing band, in accordance with example embodiments of the present disclosure.
Figure 4:
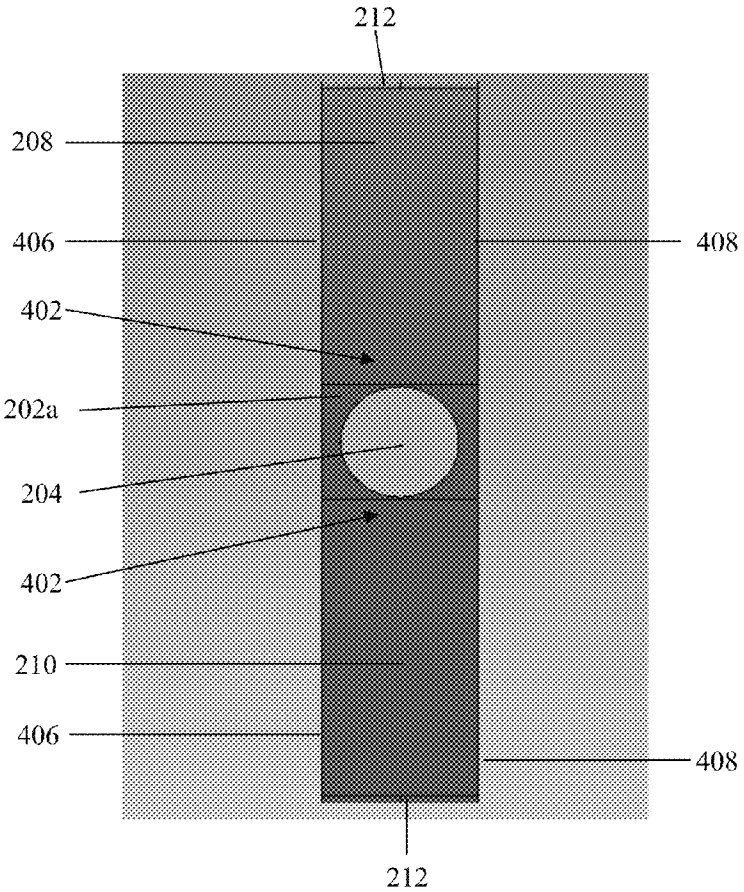
FIG. 4 illustrates a front view of the component housing band, in accordance with example embodiments of the present disclosure.
Figure 6B:
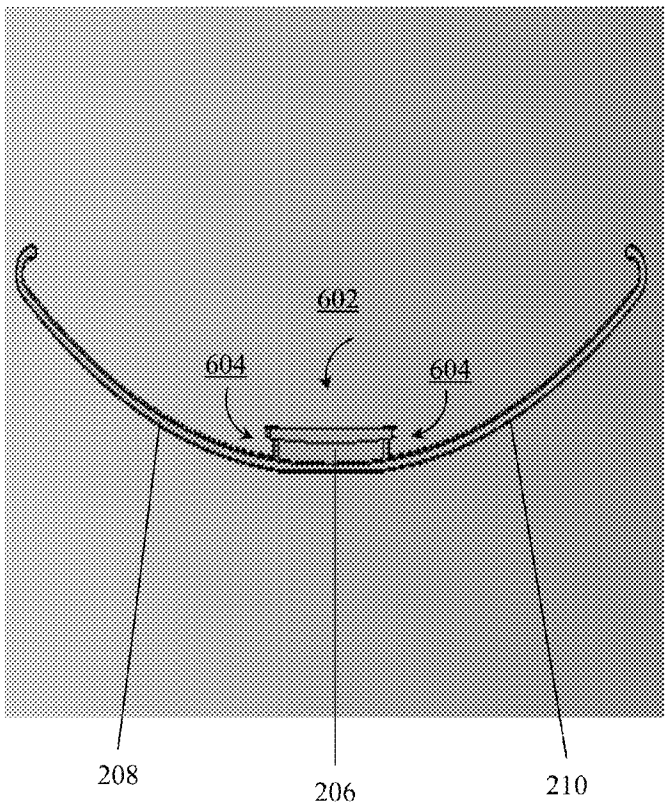
FIGS. 6A and 6B (collectively 'FIG. 6') illustrate side views of the component housing band, in accordance with example embodiments of the present disclosure.
Figure 6A:
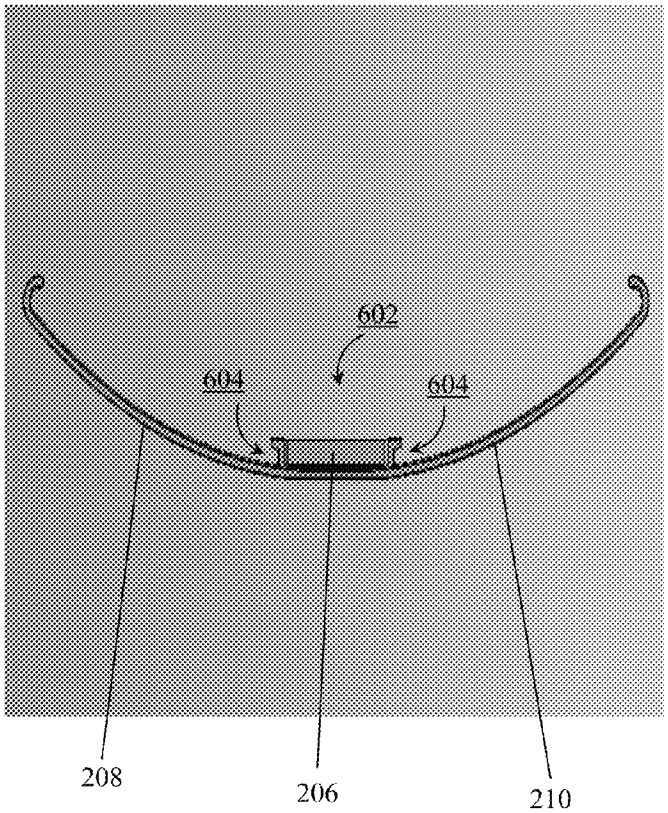
Figure 7:
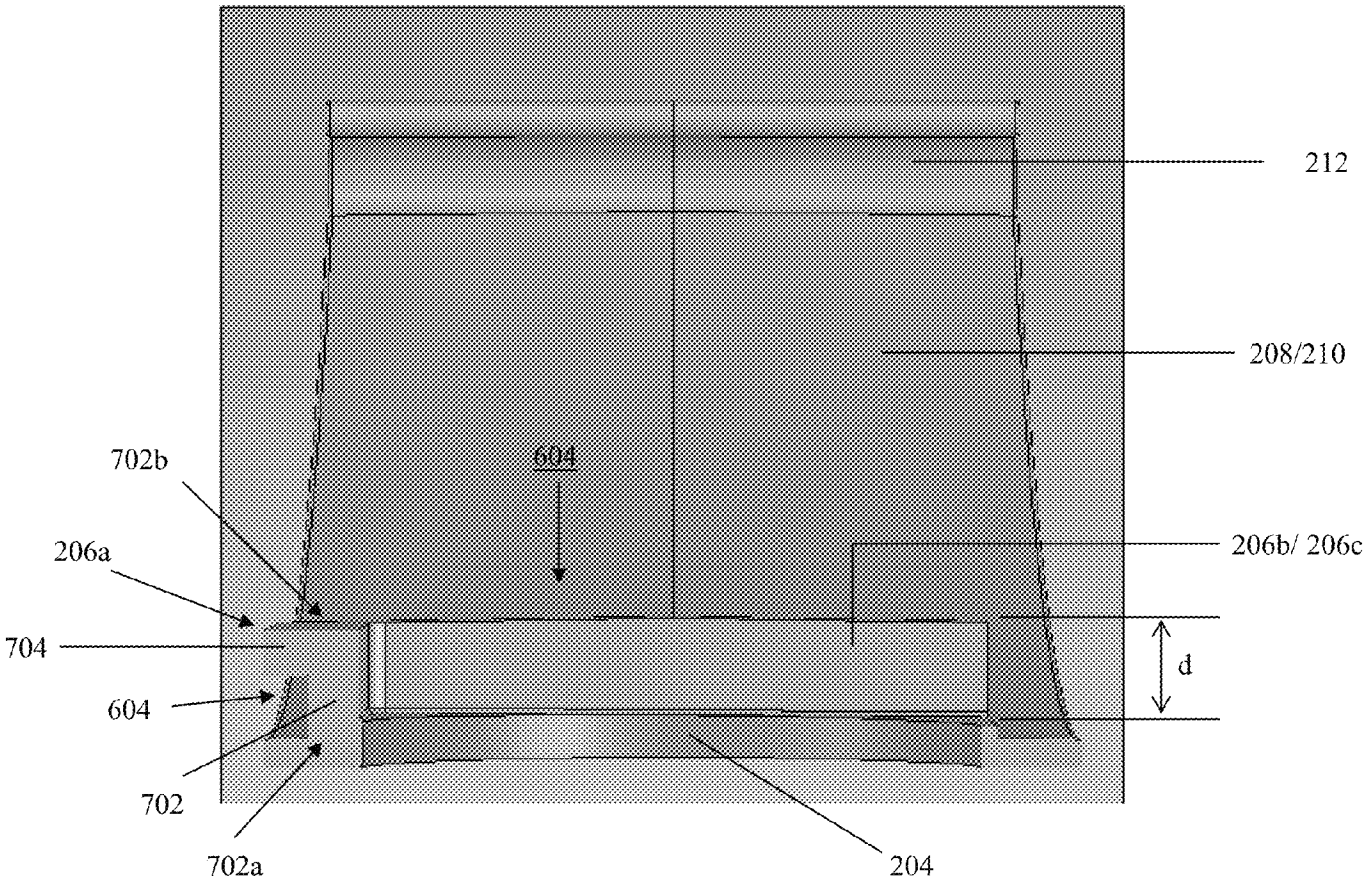
FIG. 7 illustrates a cross-sectional view of the component housing band, in accordance with example embodiments of the present disclosure.

Turning to FIGS. 2-7, these figures illustrate different views of the band 102, in accordance with example embodiments of the present disclosure. In particular, FIG. 2 illustrates a perspective view of the band; FIG. 3 illustrates another perspective view of the band from the opposite side as that shown in FIG. 2; FIG. 4 illustrates a front view of the band; FIG. 5 illustrates a rear view of the band; FIGS. 6A and 6B (collectively 'FIG. 6') illustrate side views of the band; and FIG. 7 illustrates a cross-sectional view of the band, in accordance with example embodiments of the present disclosure.

Referring to FIGS. 2-7, the band 102 may include an elongated member/body 240. Hereinafter, the elongated member 240 may be interchangeably referred to as the band 102 or vice versa. In certain example embodiments, as illustrated in FIGS. 2-7, the elongated member 240 may be curved. However, in some embodiments, the elongated member 240 may be shaped differently respective to the surface (e.g., lens 104) to which the band 102 is coupled. For example, in some embodiments, the elongated member 240 may be flat. In particular, the elongated member 240 may include a center portion 202, a first elongated arm portion 208, and/or a second elongated arm portion 210, where the first and/or second elongated arm portions (208 and 210) may be integral with the center portion 202. In other words, the elongated member 240 may be a single component where the center portion 202, the first elongated arm portion 208, and/or the second elongated arm portion 210 may be integral with each other to form the single component. Alternatively, in some embodiments, the first and/or second elongated arm portions (208 and 210) may be removably coupled to the center portion 202.

The center portion 202 may include a first surface 202*a* and a second surface 202*b*, where the first and the second surfaces (202*a*, 202*b*) face opposite directions (shown in FIGS. 4 and 5). Further, the center portion 202 may include an aperture 204 that extends from the first surface 202*a* all the way through the second surface 202*b*, i.e., the aperture 204 may be a through hole. Alternatively, in some embodiments, the aperture 204 may be a blind hole that does not go all the way through the center portion 202. Although the present disclosure describes an aperture 204 that is round in shape, one of ordinary skill in the art can understand and appreciate that the aperture 204 can have any other geometric or non-geometric shape without departing from a broader scope of the present disclosure.

Furthermore, the center portion 202 may include a mounting structure 206 that is integral with the center portion 202. The mounting structure 206 protrudes from one of the first surface 202*a* and the second surface 202*b* of the center portion 202 depending on the surface of the center portion 202 that is externally visible when the band 102 is coupled to the lens 104. In particular, the mounting structure 206 protrudes from the surface of the center portion 202 that is not externally visible when the band 102 is coupled to the lens 104. Further, the mounting structure 206 also extends in a direction that is opposite to the direction of the surface of the center portion 202 that is externally visible. For example, when the band 102 is coupled to the lens 104, the first surface 202*a* of the center portion 202 may face the lens 104 while the second surface 202*b* faces away from the lens 104 and is externally visible. In said example, the mounting structure 206 may protrude from the first surface 202*a* that faces the lens 104 and extend in a direction opposite to the second surface 202*b* that is externally visible. Alternatively, if the first surface 202*a* is externally visible, then the mounting structure 206 protrudes from the second surface 202*b* and extends in the direction opposite to the first surface 202*a*. Alternatively, in some embodiments, the mounting structure 206 may protrude from the surface of the center portion 202 that is externally visible and extend in the direction opposite to the direction of the surface that faces the lens 104 when the band 102 is coupled to the lens 104. That is, when the band 102 is coupled to the lens 104, if the second surface 202*b* is externally visible, then the mounting structure 206 protrudes from the second surface 202*b* and extends in a direction opposite to the first surface 202*a* that faces the lens 104.

As illustrated in FIGS. 5, 6, and 7, the mounting structure 206 may surround at least a portion of a perimeter of the aperture 204 and form a cavity 602 above the aperture 204 to house at least a portion of the electronic component (106 or 108). In some embodiments, while one portion of the electronic component (106, 108) rests in the cavity 602 above the aperture 204, as second portion of the electronic component (106 or 108) may protrude and extend through the aperture 204. For example, a sensor portion of the motion sensor 160 may extend through the aperture 204 and face out from the cavity 602 while being coupled to the motion sensor body that is disposed within the cavity 602 formed by the mounting structure 206.

Although the present disclosure describes the mounting structure 206 and/or the cavity 602 formed by the mounting structure 206 as being configured based on the aperture, one of ordinary skill in the art can understand and appreciate that embodiments where the size, shape, and position of the mounting structure and/or the cavity is not confined by the aperture are within a broader scope of the present disclosure. For example, in some embodiments where the band 102 does not include the aperture 204, the mounting structure 206 may be configured based on the size and shape of the electronic component that is to be accommodated and/or the size and shape of the center portion 202. Further, in another example embodiment, the mounting structure 206 may be positioned on the band 102 at a different location than the aperture 204. For example, the mounting structure 206 and the cavity 602 formed by the mounting structure 206 may be located on one of the elongated arm portions (208, 210), while the aperture 204 is located on the center portion 202 or vice-versa.

In certain example embodiments, the mounting structure 206 may be configured such that the cavity 602 formed by the mounting structure 206 can snugly fit and securely retain the electronic component without any fastening mechanisms. However, in other example embodiments, appropriate fastening mechanisms, such as screws, adhesives, etc., can be used to couple the electronic component to the band for securely retaining and housing the electronic component in the band 102. In certain example embodiments, the cavity 602 may accommodate one electronic component at a time; however, in other example embodiments, the cavity 602 may be large enough to linearly and/or vertically accommodate more than one electronic component at a time. The size of the cavity 602 may depend on the size, shape, and/or configuration of the mounting structure 206, the aperture 204, and/or the center portion 202.

Although a square/rectangular shaped cavity 602 is illustrated in the figures, one of ordinary skill in the art can understand and appreciate that the cavity can have any appropriate geometric or non-geometric shape based on the shape of the mounting structure 206. In one example embodiment, the cavity 602 may be partially enclosed by the mounting structure (206*a*, 206*b*, and 206*c*) as illustrated in the figures of the present disclosure. That is, the cavity 602 may be open on one or more sides 206*d* in addition to an opening on the top of the cavity to dispose the electronic component in the cavity 602 (e.g., top portion) and/or the aperture 204 at the bottom portion of the cavity 602. Alternatively, in another example embodiment, the cavity may be fully enclosed by the mounting structure 206 except for an opening to dispose the electronic component in the cavity 602 (e.g., top portion) and/or the aperture 204 at the bottom portion of the cavity 602. For example, if the cavity is shaped as a cuboid, the mounting structure 206 may partially or fully enclose the cuboid shaped cavity on four sides of the cuboid shaped cavity while a top portion of the cuboid may remain open and/or a bottom portion may include the opening of the aperture.

In some example embodiments, for a round aperture 204, the width and length of the cavity 602 formed by the mounting structure 206 may substantially match a diameter of the aperture 204. In other example embodiments, the width and length of the cavity 602 may be different from the diameter of the aperture 204. For example, the width and length of the cavity 602 may be larger than the diameter of the aperture 204, i.e., the aperture 204 may be smaller than the size of the cavity 602. In addition to the width and length, the cavity 602 may also have a depth (d) 706 that is defined by a height of the mounting structure 206.

In one example embodiment, the mounting structure 206 may be an L-shaped structure as illustrated in FIG. 7. The L-shaped structure creates a ledge 604 for engaging and securely retaining ends of a notch 1102 (shown in FIG. 11) of the lens 104 when the band 102 is coupled to the lens 104. In particular, the mounting structure 206 may include a first portion 702 that includes a first end 702*a* and a second end 702*b*. The first portion 702 may extend from one of the first surface 202*a* and the second surface 202*b* of the center portion 202 in a direction that is substantially normal to the respective surface from which it extends. Alternatively, in some embodiments, the first portion 702 may extend at an angle with respect to the surface from which it extends. Further, in certain example embodiments, the mounting structure may include a second portion 704, e.g., a flange that extends from the second end 702*b* of the first portion 702 in a direction that is substantially perpendicular to first portion 702 and away from the aperture 204. In some embodiments, the second portion 704 may be at an obtuse or acute angle with respect to the first portion 702 and/or the second portion 704 may extend in a direction towards the aperture 204 such that it supports at least a portion of the electronic component 106/108 housed in the cavity 602 formed by the mounting structure. In particular, the second portion 704 of the mounting structure 206 may form the ledge 604 in unison with the first portion 702 to support and securely retain the ends of the notch 1102. However, in certain other embodiments, the mounting structure 206 may not include the second portion 704. One of ordinary skill in the art can understand and appreciate that any other support mechanism instead of or in addition to the second portion can be used to support and engage the ends of the notch 1102 without departing from a broader scope of this disclosure. For example, instead of or in addition to the second portion, the mounting structure 206 may include a recess or indentation in the first portion to engage, support, and securely retain the ends of the notch 1102.

Referring to FIGS. 2-7, in addition to the center portion 202, the elongated member 240 may include a first elongated arm portion 208 and/or a second elongated arm portion 210. Each elongated arm portion may be integral with the center portion 202 and may extend in opposite directions from opposite ends of the center portion 202. For example, the first elongated arm portion 208 extends from a first end 202*c* of the center portion 202 and the second elongated arm portion 210 extends from a second end 202*d* of the center portion 202, where the first end 202*c* and the second end 202*d* of the center portion 202 are opposite to each other. In the example embodiment illustrated in the figures, the center portion 202 comprising the mounting structure 206 and the aperture 204 is located substantially at a mid-point of the elongated member 240 and is sandwiched between the first elongated arm portion 208 and the second elongated arm portion 210. However, one of ordinary skill in the art can understand and appreciate that in some embodiments the center portion 202 comprising the mounting structure 206 and the aperture 204 may be offset from the mid-point of the elongated member 240 and be sandwiched between the first elongated arm portion 208 and the second elongated arm portion 210.

Each of the first and second elongated arm portions (208, 210) may have a first lateral edge 402 coupled to the center portion 202, a second lateral edge 212 opposite to the first lateral edge 402, and first and second longitudinal edges (406, 408) that extends between the first and second lateral edges (402, 212) of the respective elongated arm portions (208, 210). Although the figures of the present disclosure illustrate dimensions of the lateral edges of the elongated arm portions (208, 210) being uniform with the dimensions of the first and second ends (202*c*, 202*d*) of the center portion 202, one of ordinary skill in the art can understand and appreciate that in some embodiments the dimensions of the lateral edges (402, 212) of the elongated arm portions (208, 210) may be non-uniform with respect to the first and second ends (202*c*, 202*d*) of the center portion 202. For example, the elongated arm portions (208, 210) may have a smaller or larger width compared to the center portion 202. Further, in some embodiments, the dimensions of the elongated arm portions (208, 210) may not be uniform. For example, the width of the elongated arm portions (208, 210) may taper from one lateral end to the other. In other words, the first elongated arm portion 208 and/or the second elongated arm portion 210 can assume any appropriate shape and size without departing from a broader scope of the present disclosure.

Figure 11:
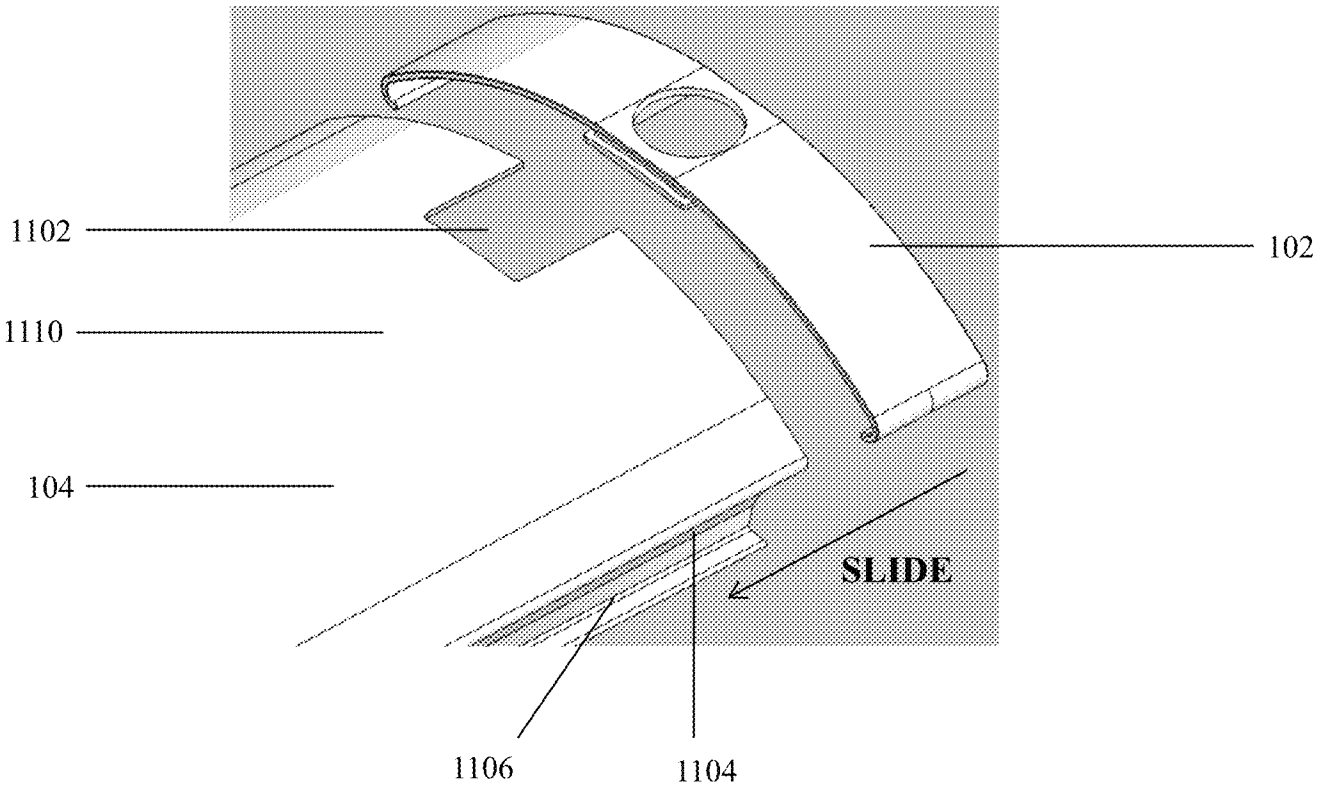
FIG. 11 illustrates a coupling of the component housing band with a lens of the luminaire, in accordance with example embodiments of the present disclosure.
Figure 12A:
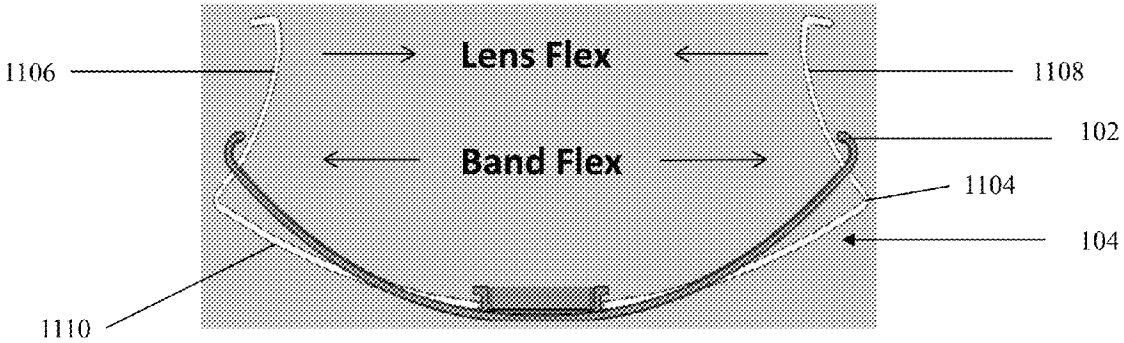
FIGS. 12A and 12B (collectively 'FIG. 12') illustrate an interference fit of the component housing band with the lens of the luminaire, in accordance with example embodiments of the present disclosure.
Figure 12B:
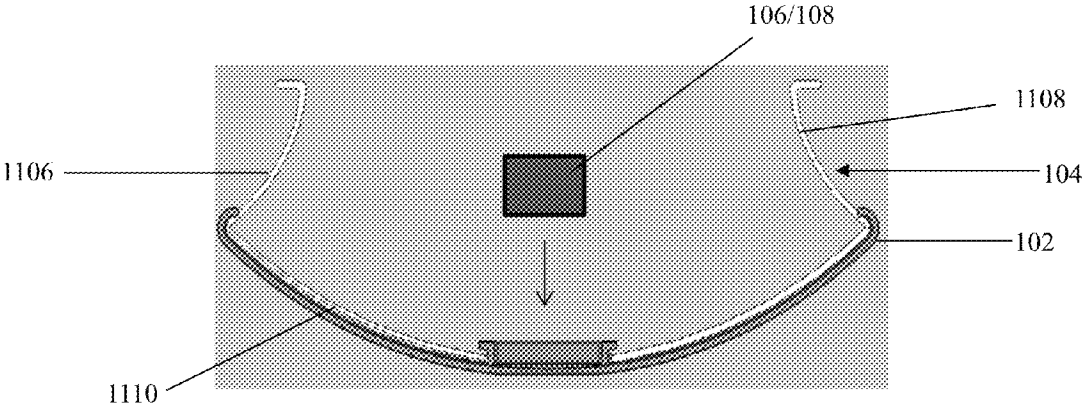

In certain example embodiments, the second lateral ends 212 of the first elongated arm portion 208 and/or the second elongated arm portions 210 that are opposite to each other may be shaped as hooks to engage a band latch 1104 of the lens 104 (see FIGS. 11 and 12). However, in other example embodiments, the second lateral end 212 of each elongated arm portion (208, 210) can assume any other appropriate shape without departing from a broader scope of the present disclosure. That is, the second lateral ends 212 may be adapted to engage any appropriate surface/component to which the band 102 is coupled using any appropriate coupling mechanism.

In certain example embodiments, the first elongated arm portion 208 and/or the second elongated arm portion 210 may provide a concealed wire way to run electrical wires to the electronic component (106, 108) and/or the luminaire 100 in a concealed manner. The elongated arm portions (208, 210) of the band 102 may cover at least a portion of the lens 104 when the band 102 is coupled to the lens 104. The portion of the lens that is covered by the elongated arm portions of the band 102 allows to run electrical wires in a concealed manner and to conceal shadows of the electronic component (106, 108).

In one example embodiment, the elongated member 240 may be a single continuous structure formed by the center portion 202, the first elongated arm portion 208, and the second elongated arm portion 210. In said example embodiment where the elongated member 240 is a single continuous structure, the second lateral ends 212 of the first and second elongated arm portions (208, 210) may constitute the lateral ends of the elongated member 240. Similarly, the longitudinal ends (406, 408) of the first and the second elongated arm portions (208, 210) along with the ends of the center portion 202 that extend between the first end 202*c* and the second end 202*d* constitute the longitudinal ends of the entire elongated member 240. In other words, the elongated member 240 may be a single continuous member that has a first and second lateral ends 212 that are opposite to each other, and a first and second longitudinal ends, where each longitudinal end extends between the first and the second lateral ends 212.

Figure 9:
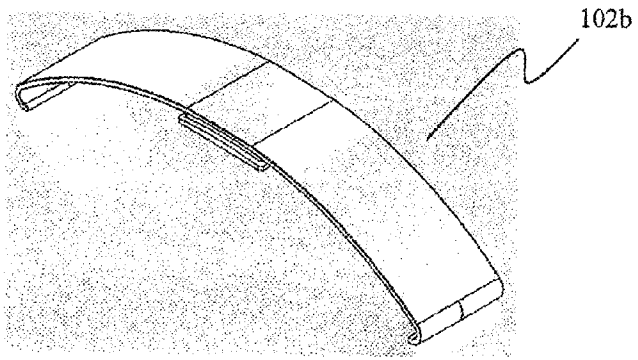
FIG. 9 illustrates another example component housing band, in accordance with example embodiments of the present disclosure.
Figure 8:
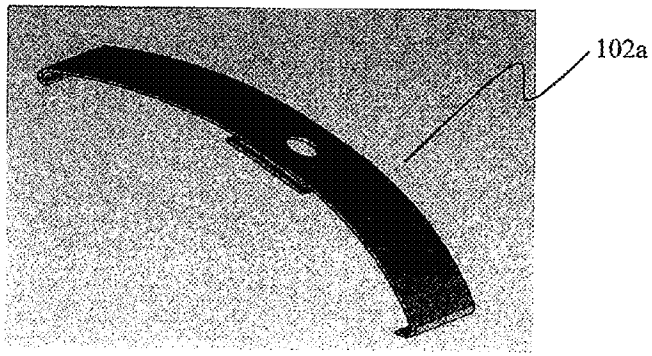
FIG. 8 illustrates an example component housing band, in accordance with example embodiments of the present disclosure.
Figure 10:
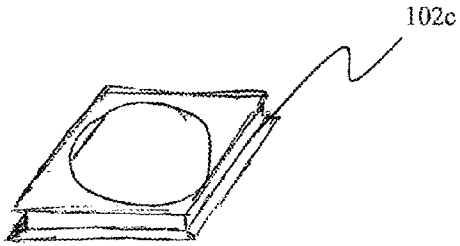
FIG. 10 illustrates yet another example component housing band, in accordance with example embodiments of the present disclosure.

Turning to FIGS. 8-10, these figures illustrate different example bands 102. In particular, FIG. 8 illustrates a band 102 having a smaller aperture 204 compared to the aperture 204 of the band 102 in FIGS. 2-7. Accordingly, one of ordinary skill in the art can understand and appreciate that the band 102 may have an aperture 204 of any appropriate shape or size without departing from a broader scope of this disclosure. Further, the band 102 may have more than one aperture without departing from a broader scope of this disclosure. Alternatively, in another example embodiment, the band 102 may not include an aperture 204 as illustrated in FIG. 9. In yet another example embodiment, the band 102 may not include the first and second elongated arm portions 208 and 210 as illustrated in FIG. 10. That is, the band 102 may only include a center portion 202 along with the mounting structure 206 and/or the aperture 204, where the center portion 202 may be coupled to the lens 104 such that the mounting structure 206 of the center portion 202 engages the ends of the notch 1102 of the lens 104. Alternatively, the mounting structure 206 may be a part of the electronic component (106, 108). For example, a housing of the electronic component (106, 108) may be fabricated with the mounting structure 206 to allow the electronic component (106, 108) to be coupled to the lens 104 by engaging the mounting structure 206 with the end of the notch 1102.

Although the present disclosure describes a mounting structure 206 that is integral with the band 102, one of ordinary skill in the art can understand and appreciate that in some embodiments the band 102 may not include the mounting structure 206. In the embodiment where the mounting structure 206 is absent, other mechanisms, such as adhesives, screws, etc., may be used for coupling the electronic components 106/108 to the band 102. Further, in said embodiment, the band 102 may be removably coupled to lens 104 by way of coupling the lateral ends 212 of the band 102 to the band latch 1104 of the lens 104. A process of coupling the band 102 to the lens 104 is illustrated in FIGS. 11 and 12 and described in greater detail below in association with FIGS. 11 and 12.

Coupling the Component Housing Band to the Lens

Turning to FIGS. 11 and 12, these figures illustrate an example mechanism of coupling the band 102 to the lens 104. As illustrated in FIG. 11, in certain example embodiments, the lens 104 may include a first mounting wall 1106, a second mounting wall 1108, and a lens surface 1110, where the first mounting wall 1106 and the second mounting wall 1108 are coupled to respective ends of the lens surface 1110 such that the coupling forms a band latch portion 1104 to engage lateral ends 212 of the band 212. Further, the lens 104 may include notches 1102 on either one or both of the lateral ends of the lens 104. Alternatively, if the band is designed to fit along a longitudinal portion of the lens 104, the notch 1102 may be formed on either one of or both the longitudinal ends of the lens 104.

Referring to FIG. 11, the band 102 may be configured to slide onto the lens 104 along a lateral end of the lens 104 such that the band 102 is disposed on top of the lens 104. In particular, the band 102 slides into the notch 1102 in the lens 104 and hooks on the band latch on the edges of the lens 104. That is, the lateral ends 212 of the band 102 may engage and retain the band latch 1104 of the lens 104 on both ends and/or the mounting structure 206 may engage and retain the edges of the notch 1102. As illustrated in FIG. 12A, in a relaxed state, the band 102 and the lens 104 may have different radii to allow for an interference fit in a coupled state. Further, the band 102 and/or the lens 104 (e.g., the first mounting wall 1106 and the second mounting wall 1108 of the lens 104) may be flexible independent of each other to allow the interference fit and to follow a contour of the lens 104 once coupled. Accordingly, the band 102 and/or the lens 104 may be flexed as illustrated in FIG. 12A to mate the band 102 to the lens 104 by interference fit. Once the lens 104 and the band 102 are flexed and mated together, a gap between the lens 104 and the band 102 is maintained and the lens 104 and the band 102 stay engaged during flex of the lens assembly. That is, once the lens 104 and the band 102 are coupled, they may flex together.

Further, the first portion 702 of the mounting structure 206 may provide a stopping mechanism to prevent the band 102 from sliding any further once the mounting structure engages the ends of the notch 1102. However, in some embodiments, the mounting structure 206 may be absent and accordingly, the band 102 may be coupled to the lens 104 by engaging the lateral ends 212 of the band with the band latch 1104 of the lens 104. Alternatively, the band 102 may be coupled to the lens 104 by any other appropriate coupling mechanism such as adhesives, screws, etc. In other words, although the present disclosure describes fastening the band 102 to the lens 104 by interference fit, one of ordinary skill in the art can understand and appreciate that any other appropriate mechanism for coupling the band 102 to the lens 104 may be used without departing from a broader scope of this disclosure.

In certain example embodiments, the band 102 may formed using polycarbonate material; however, in other embodiments, one of ordinary skill in the art can understand and appreciate that the band 102 may be formed using any other appropriate materials, e.g., metal, without departing from a broader scope of the present disclosure. Further, the band 102 may be coated with materials that may increase an aesthetic appeal of the luminaire. For example, the band 102 may be finished with chrome plating, an anti-microbial coating, or the band 102 may be coated with any appropriate color. Furthermore, designs may be etched on the band 102 for both aesthetics and to improve light focus, dispersion, and/or transmission.

Although embodiments described herein are made with reference to example embodiments, it should be appreciated by those skilled in the art that various modifications are well within the scope and spirit of this disclosure. For example, each feature of one embodiment can be mixed and matched with other features shown in other embodiments. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A luminaire comprising:
at least one light source;
a lens disposed over the at least one light source; and
an elongated member removably coupled to the lens and configured to house an electronic component, wherein the elongated member comprises:
a center portion that comprises:
a top surface and a bottom surface facing a direction that is opposite to that of the top surface; and
a mounting structure extending perpendicularly from one of the top surface and the bottom surface;
a first elongated arm portion integral with the center portion and extending away from a first end of the center portion in a first direction; and
a second elongated arm portion integral with the center portion and extending away from a second end of the center portion in a second direction that is opposite to the first direction,
wherein the second end is opposite to the first end, and
wherein ends of the first elongated arm portion and the second elongated arm portion that are opposite to the center portion are adapted to engage with corresponding latch structures of the lens to removably couple the elongated member to the lens.

2. The luminaire of claim 1, wherein the mounting structure forms a cavity to house the electronic component.

3. The luminaire of claim 1, wherein the mounting structure is adapted to securely engage a notch in the lens when the elongated member is removably coupled to the lens, and wherein the notch is formed in a lateral edge of the lens.

4. The luminaire of claim 1, wherein the elongated member is flexible to interference fit the lens and follow a contour of the lens when removably coupled to the lens.

5. The luminaire of claim 1, wherein the ends of the first elongated arm portion and the second elongated arm portion are shaped as hooks.

6. The luminaire of claim 1, wherein the mounting structure comprises:
a first portion that is coupled to the center portion, wherein the first portion extends perpendicularly from the center portion; and
a second portion that extends perpendicularly from the first portion and away from the aperture, wherein the second portion is substantially parallel to the top surface and the bottom surface of the center portion.

7. The luminaire of claim 1, wherein the first elongated arm portion and the second elongated arm portion provide a concealed wire way to conceal electrical wires associated with the electronic component.

8. A band apparatus that houses one or more electronic components in a luminaire, the band apparatus comprising:
a center portion that comprises:
a top surface and a bottom surface facing a direction that is opposite to that of the top surface;
an aperture extending from the top surface through the bottom surface; and
a mounting structure disposed adjacent to the aperture and extending perpendicularly from the top surface,
wherein the mounting structure surrounds at least a portion of a perimeter of the aperture and forms a cavity to house the one or more electronic components,
wherein the cavity is located above the aperture such that at least a portion of the electronic component rests in the cavity above the aperture, and
wherein the mounting structure is adapted to securely engage a notch in a lens of the luminaire when the band apparatus is coupled to the lens; and
a pair of elongated arms that are removably coupled to opposite edges of the center portion, wherein ends of the elongated arms that are away from the center portion and opposite to each other are adapted to engage with corresponding latch structures of the lens of the luminaire to removably couple the band apparatus to the lens.

9. The band apparatus of claim 8, wherein the band apparatus is disposed over the lens such that the mounting structure of the band apparatus covers the notch in the lens.

10. The band apparatus of claim 8, wherein the mounting structure has an L shaped cross-sectional profile.

11. The band apparatus of claim 10, wherein the mounting structure comprises:
a first portion that is coupled to the center portion, wherein the first portion extends perpendicularly from the top surface of the center portion; and
a second portion that extends perpendicularly from the first portion and away from the aperture, wherein the second end is opposite to the first end of the first portion, wherein the second portion is substantially parallel to the top surface of the center portion.

12. The band apparatus of claim 8, wherein the one or more electronic components include at least one of a sensor and an emergency test switch.

13. A lighting system, comprising:
at least one light source;
a lens disposed over the at least one light source;
an elongated member housing a component, wherein the elongated member comprises:
a first surface and a second surface facing a direction that is opposite to the first surface, wherein the first surface and the second surface are bound by:
a first lateral edge and a second lateral edge opposite to the first lateral edge, wherein each of the first lateral edge and the second lateral edge is adapted to engage with a corresponding latch structure of the lens; and a first longitudinal edge and a second longitudinal edge opposite to the first longitudinal edge, wherein each of the first longitudinal edge and the second longitudinal edge extends between the first lateral edge and the second lateral edge of the elongated member;

an aperture disposed between the first longitudinal edge and the second longitudinal edge, wherein the aperture extends from the first surface through the second surface; and a mounting structure disposed extending substantially perpendicularly from one of the first surface and the second surface, wherein the mounting structure forms a cavity to house the component.

14. The lighting system of claim 13, wherein the elongated member is flexible to form an interference fit with the lens and follow a contour of the lens when the elongated member is removably coupled to the lens.

15. The lighting system of claim 13, wherein the first lateral edge and the second lateral edge are shaped as hooks.

16. The lighting system of claim 13, wherein the elongated member is curved.

17. The lighting system of claim 13, wherein the elongated member provides a concealed wire way to conceal electrical wires associated with at least one of the component and the lighting system.

18. The lighting system of claim 13, wherein the mounting structure comprises:

a first portion that is coupled to one of the first surface and the second surface of the center portion at a first end, wherein the first portion extends from a corresponding surface of the center portion in a direction that is substantially normal to the corresponding surface of the center portion; and a second portion that extends from a second end of the first portion in a direction that is substantially perpendicular to the first portion and away from the aperture, wherein the second end is opposite to the first end of the first portion, wherein the second portion is substantially parallel to the corresponding surface of the center portion.

19. The lighting system of claim 13, wherein the component includes one of a motion sensor and an emergency test switch.

* * * * *